US009380917B2

(12) United States Patent
Eilmus et al.

(10) Patent No.: US 9,380,917 B2
(45) Date of Patent: Jul. 5, 2016

(54) DISPENSER SYSTEM FOR DISPOSABLE WIPES

(71) Applicant: Kohler Co., Kohler, WI (US)

(72) Inventors: Niels Eilmus, Sheboygan, WI (US); Ryan Detlaff, Sheboygan, WI (US); Madison Kay Smith, Raleigh, NC (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 14/536,934

(22) Filed: Nov. 10, 2014

(65) Prior Publication Data

US 2015/0129605 A1 May 14, 2015

Related U.S. Application Data

(60) Provisional application No. 61/902,534, filed on Nov. 11, 2013.

(51) Int. Cl.

| | |
|---|---|
| ***A47K 10/32*** | (2006.01) |
| ***B65D 83/08*** | (2006.01) |
| ***A47K 10/38*** | (2006.01) |
| *A47K 5/12* | (2006.01) |

(52) U.S. Cl.

CPC ..... *A47K 10/38* (2013.01); *A47K 10/3818* (2013.01); *B65D 83/08* (2013.01); *A47K 2005/1218* (2013.01); *A47K 2010/3206* (2013.01); *A47K 2010/3233* (2013.01); *A47K 2010/3266* (2013.01)

(58) Field of Classification Search

CPC ..... A47K 10/42

See application file for complete search history.

(56) References Cited

U.S. PATENT DOCUMENTS

| | | | | |
|---|---|---|---|---|
| 7,287,720 | B1 * | 10/2007 | Allegre | A47K 10/38 206/409 |
| 7,815,074 | B2 * | 10/2010 | Ciavarella | A47K 5/12 141/383 |
| 2004/0206769 | A1 * | 10/2004 | Sanders | A47K 10/422 221/59 |
| 2007/0017932 | A1 | 1/2007 | Ciavarella et al. | |
| 2008/0017684 | A1 * | 1/2008 | Digiacomo | A47K 10/421 225/14 |
| 2014/0326745 | A1 * | 11/2014 | Young | A47K 10/422 221/45 |

FOREIGN PATENT DOCUMENTS

| | | | |
|---|---|---|---|
| CN | 101810449 | A | 8/2010 |
| WO | WO-2013/055340 | A1 | 4/2013 |

* cited by examiner

*Primary Examiner* — Leslie A Nicholson, III
*Assistant Examiner* — Ayodeji Ojofeitimi
(74) *Attorney, Agent, or Firm* — Foley & Lardner LLP

(57) ABSTRACT

A disposable wipes dispenser system includes a case that houses a disposable wipes container and a cover that is mounted to a mounting hole disposed within a mounting surface. The case engages the cover from below the mounting surface, and the disposable wipes are accessible from above the mounting hole when the case is engaged with to the cover.

17 Claims, 9 Drawing Sheets

DISPENSER SYSTEM FOR DISPOSABLE WIPES

CROSS-REFERENCE TO RELATED PATENT APPLICATIONS

This application claims priority to and the benefit of U.S. Provisional Patent Application No. 61/902,534, filed on Nov. 11, 2013, the entirety of which is incorporated herein by reference.

BACKGROUND

This application relates generally to the field of containers and dispenser systems for disinfecting wipes (e.g., disposable wipes, hygienic wipes, etc.), such as the type that are commercially available and packaged in cylindrical canisters. More specifically, this application relates to an improved system for dispensing disinfecting wipes, which positions a disinfecting wipes container below a countertop, and allows the disinfecting wipes to be accessed from above the countertop.

Disinfecting wipes may be packaged in a cylindrical roll, similar to a roll of paper towels or toilet paper (except, in the case of a roll of disinfecting wipes, the wipes are not typically rolled around a tube, such as a cardboard tube used with a roll of paper towels). The cylindrical roll of disinfecting wipes is then placed within a cylindrical canister, which may be provided as a standard size by various manufacturers. Commercially available cylindrical canisters for disinfecting wipes include a cover, which may be coupled onto the canister in a variety of ways (e.g., threadably coupled, snap-fit, etc.). The cover for a canister of disinfecting wipes also includes an aperture through which disinfecting wipes may be pulled through. Disinfecting wipes are typically saturated in a volatile disinfecting solution. In order to prevent the disinfecting solution from evaporating out of the canister, the cover of the disinfecting wipes canister includes a lid to cover the aperture when the canister is not being used. The lid may be coupled to the cover through a hinge, such as a flexible "living hinge." The disinfecting wipes in the roll are generally perforated, so that a single wipe may be pulled from the canister, and ripped from the remaining wipes in the roll.

Disposable disinfecting wipes provide users with a quick and convenient way to disinfect and clean various areas throughout a house which are susceptible to bacteria and viruses, such as a kitchen or a bathroom. In some households, disinfecting wipes containers are used so frequently that users keep the containers within close reach, such as on top of a table or countertop. As a result, the disinfecting wipes containers add to the clutter already on the table or counter, and the available surface area for the table or counter that may be used for other tasks (e.g., preparing food, drying dishes, etc.) is reduced. Thus, it would be advantageous to store a disinfecting wipes container underneath a mounting surface, such as a countertop or a sink, so that the available surface area of a countertop is not reduced, so that the overall appearance of the countertop is improved, and so that the disinfecting wipes are quickly accessible.

SUMMARY

According to an exemplary embodiment, a disposable wipes dispenser system includes a case configured to contain a disposable wipes container and a cover configured to mount to a mounting hole disposed within a mounting surface. The case is configured to couple to the cover from below the mounting surface, and the disposable wipes are accessible from above the mounting hole when the case is coupled to the cover.

According to an exemplary embodiment, a disposable wipes dispenser system includes a cover including a lid and a shank, and a funnel configured to couple to a disposable wipes container. The shank is configured to be received by a mounting hole disposed within a mounting surface, and the cover is positioned above the mounting surface when the shank is received by the mounting hole. The funnel is configured to couple to the cover when the funnel is positioned underneath the mounting surface. The disposable wipes may be accessed through the cover when the funnel and disposable wipes container are coupled thereto.

According to another exemplary embodiment, a disposable wipes dispenser system includes a disposable wipes container and a cover configured to mount to a mounting hole disposed within a rear deck of a sink. The disposable wipes container is coupled to the cover from below the rear deck, and the disposable wipes are accessible from above the mounting hole when the disposable wipes container is coupled to the cover.

DETAILED DESCRIPTION

Referring generally to the FIGURES, disclosed herein are exemplary embodiments for a system to dispense disinfecting wipes, in which a disinfecting wipes container is mounted below a mounting surface (e.g., a countertop, a rear deck of a sink, a table, or any suitable mounting surface) and the wipes are accessible from above the mounting surface. As a result, a greater surface area of the mounting surface may be available to accomplish other tasks, such as preparing food.

According to an exemplary embodiment, it may be advantageous to maximize the available surface area for a countertop, such as a kitchen or bathroom countertop. Further, it may be advantageous to maximize the available surface area for a countertop in a way that does not substantially decrease the accessibility of items that are used regularly, such as a disinfecting wipes container. According to an exemplary embodiment, a dispensing system for disinfecting wipes is disclosed, which allows a disinfecting wipes container to be positioned beneath a bottom surface of a countertop or a sink, so that the container is out of the way, while also allowing the disinfecting wipes to be conveniently accessed from a top surface of the countertop/sink.

Figure 1:
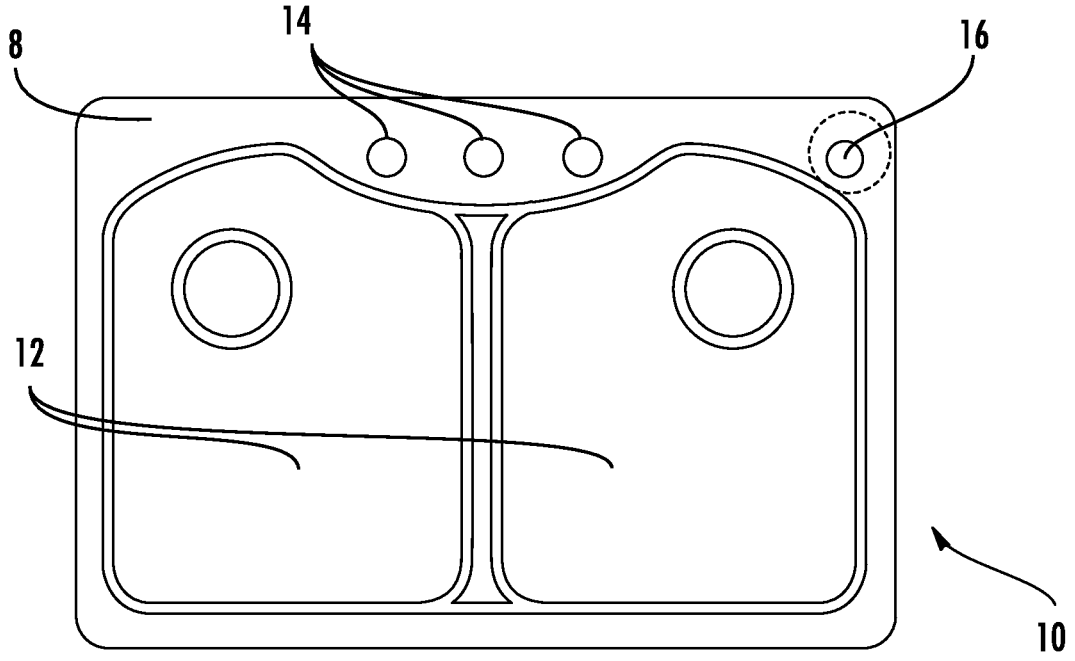
FIG. 1 illustrates a top plan view of a kitchen sink, according to an exemplary embodiment.

FIG. 1 illustrates an exemplary embodiment of a kitchen sink 10 including a rear sink deck 8 which is positioned behind two basins 12. Although the sink 10 is shown as having two basins 12, the sink 10 may include a lesser or greater number of basins. A series of holes or apertures 14 are disposed within the sink deck 8, and the diameter of the holes 14 may be of a standard size, such as 1⅜ inches (approximately 3.5 cm), which is used to mount a variety of sink fixtures and sink accessories (e.g., faucets, sprayers, etc.). As shown in FIG. 1, the holes 14 may be arranged as a centrally and horizontally aligned row of 3 holes. At least one of the holes in the sink deck 8 (typically the centermost hole) may be used to mount a faucet spout. Also, 1-2 holes may be used to mount a faucet valve(s).

In addition to the central row of sink holes 14, the sink deck may also include a hole that is positioned toward a far left or a far right side of the sink 10, such as a hole or aperture 16. For example, the hole 16 is depicted in FIG. 1 as positioned proximate a right side of the sink deck 8, and the hole 16 may be used to mount a sink accessory, such as a soap dispenser or a side-spray. According to an exemplary embodiment, the hole 16 may be used to mount a variety of sink accessories, one accessory being a dispensing system 18 which may be used to dispense disinfecting wipes. The hole 16 may be of a conventional size for a faucet hole of a sink, such as 1⅜ inches, or it may be any other suitable size used to accommodate a sink accessory, such as a soap dispenser or a side spray. Further, the sink 10 may provide a small clearance (i.e., approximately 1½ inches) between an exterior surface of the basin 12 and the hole 16.

Referring to FIG. 2, the sink 10 is configured as a drop-in mounted sink, which is mounted within a hole disposed within a countertop. The countertop may be positioned onto a series of cabinets, and cabinet doors may be installed in front of the basins 12. The cabinet doors may be used to conceal the basins 12 and provide access to the plumbing underneath the sink 10. Further, the holes 14, 16 may be accessed through the cabinet doors, behind the basins 12. According to other exemplary embodiments, the sink may be of the undermount type and/or the hole 16 may be provided in a countertop or other surface to which the sink is mounted.

Figure 2A:
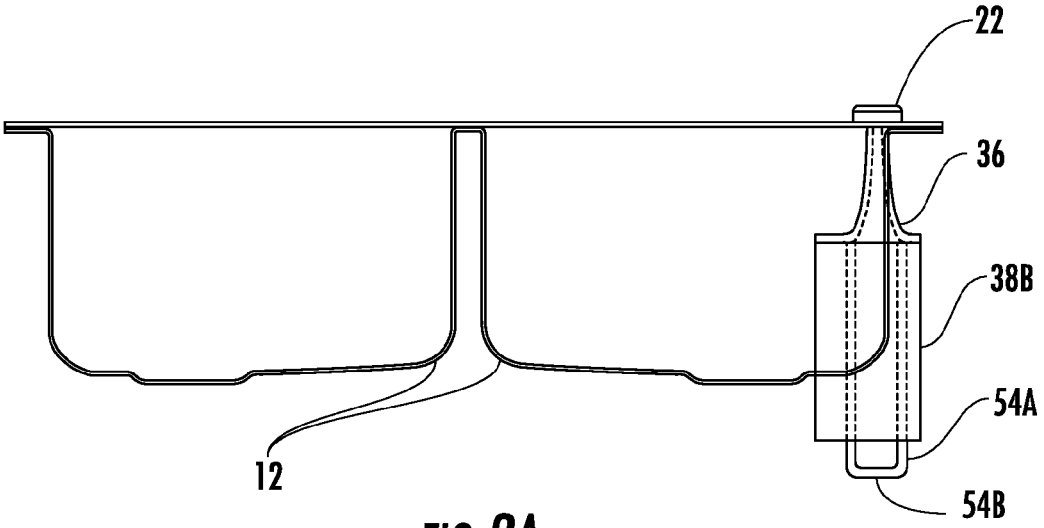
FIG. 2A is a front view of a sink and a dispensing wipes system, according to an exemplary embodiment.
Figure 2B:
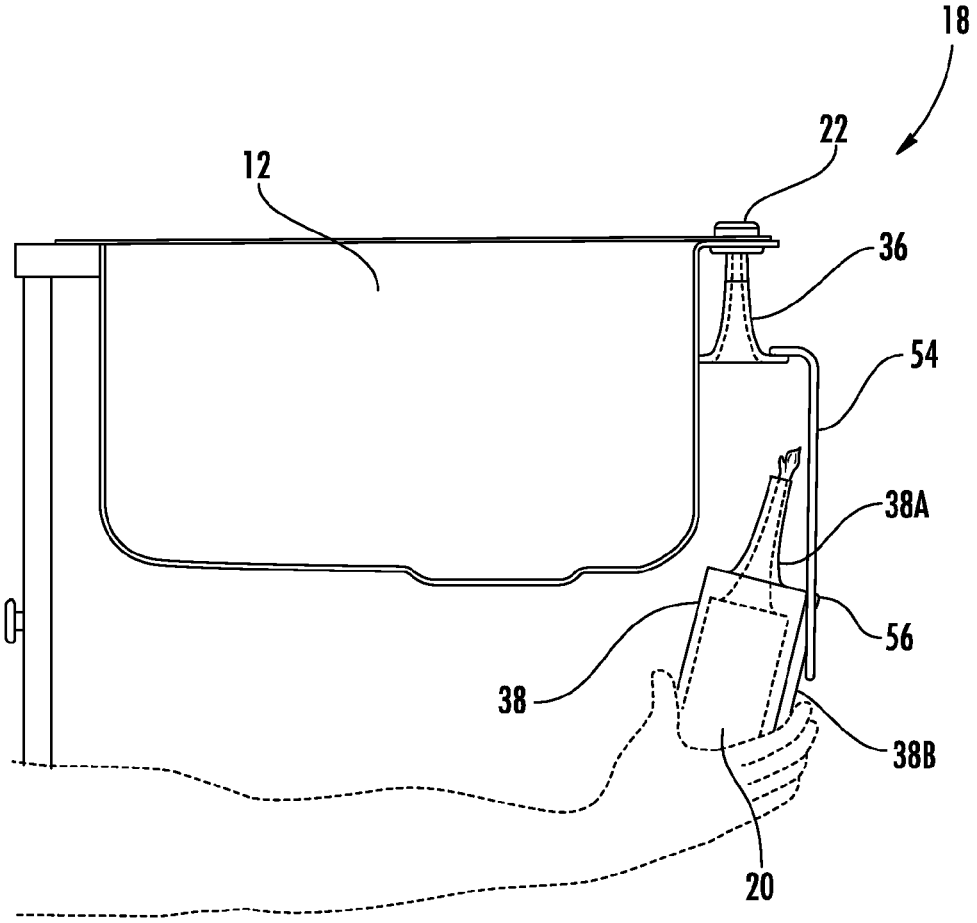
FIG. 2B is a side view of a sink and a dispensing wipes system, according to an exemplary embodiment.

FIGS. 2A-2B illustrate an exemplary embodiment of the dispensing system 18, which is configured to be coupled to the hole 16. As shown in FIG. 2B, the dispensing system 18 may include a tapered connecting member shown having a generally funnel-shaped opening (hereinafter referred to as funnel 36 for brevity), a case 38, and a cover 22. The cover 22 is configured to be positioned above a top surface of a mounting surface (e.g., the sink deck 8), and to couple to the hole 16. Disclosed herein are various exemplary embodiments for a funnel 36 and a case 38 (see, e.g., FIGS. 2B, 4, 6A, and 7-10). The various funnels and cases disclosed herein are configured to be positioned below a bottom surface of a mounting surface, between an exterior surface of the basin 12 and a wall of a cabinet. The various funnels disclosed herein are configured to couple to a cover (e.g., the cover 22). The various cases disclosed herein are configured to house (i.e., contain, hold, etc.) a container that contains a roll of disinfecting wipes, and couple to a funnel and a cover. According to other embodiments, the size, shape, and configurations of the funnels and case may differ.

Figure 3A:
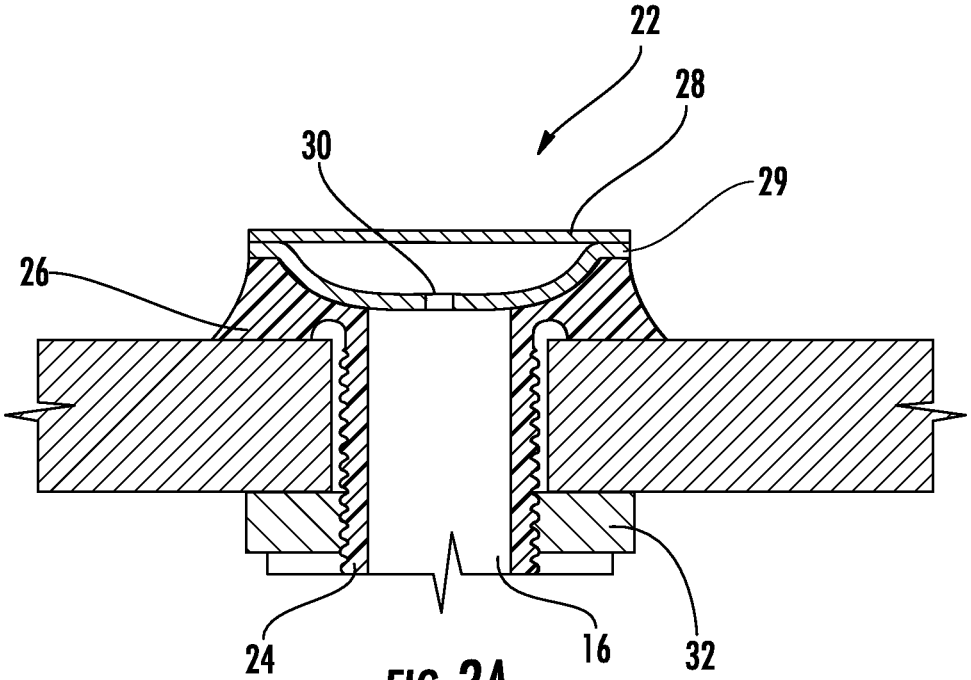
FIG. 3A is a cross-sectional view of a cover for the dispensing wipes system shown in FIGS. 2A-2B, according to an exemplary embodiment.
Figure 3B:
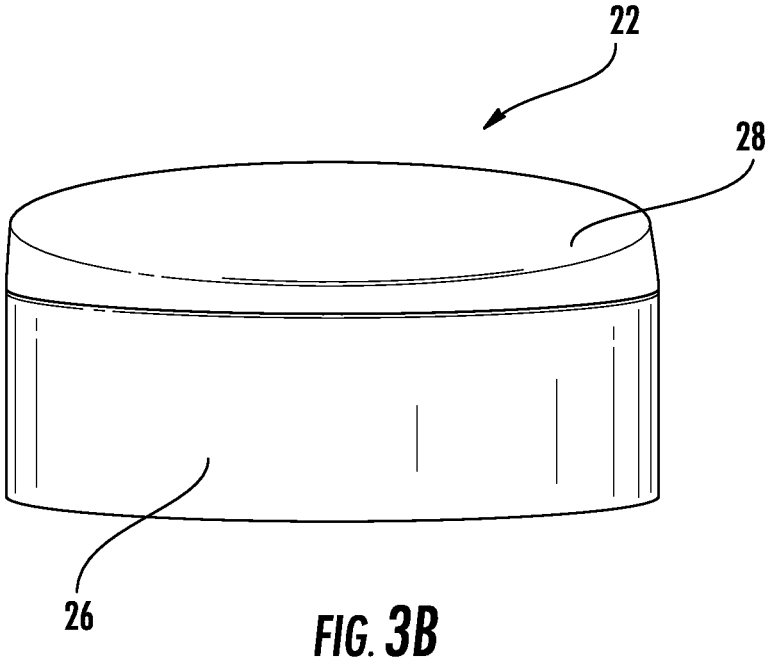
FIG. 3B is a perspective view of a cover for a dispensing wipes system, according to an exemplary embodiment.

Referring to FIGS. 3A and 3B, according to an exemplary embodiment, the lid or cover 22 is configured to be coupled to the hole 16 disposed within the sink deck 8. According to another exemplary embodiment, the cover 22 may be coupled to a hole disposed within any suitable mounting surface, such as a countertop or table. The cover 22 may include a base 26, a liner 29, a lid 28, and a shank 24. According to an exemplary embodiment, the base 26 may be generally cylindrical. According to other exemplary embodiments, the base 26 may have any suitable configuration.

According to an exemplary embodiment, a liner (e.g., a silicone liner) 29 may be coupled to an upper surface of the base 26. For example, the liner 29 may be overmolded to the base 26, coupled to the base 26 via an adhesive, or coupled to the base 26 via a series of protrusions and divots (not shown) provided on either the liner 29 and/or the base 26. According to an exemplary embodiment, the material used for the liner 29 is easy-to-clean, and/or hydrophobic. As shown in FIG. 3A, a generally round hole 30 (e.g., aperture) is disposed within a central portion of the liner 29. According to other exemplary embodiments, the liner 29 may include any suitable aperture (e.g., a slit, ellipse, oval, cross, star, pentagram, rectangle, etc.). The hole 30 is configured such that, when the cover 22 is coupled to the hole 16, the hole 30 is positioned concentrically above the hole 16. The hole 30 is also configured to allow a disinfecting wipe to be pulled therethrough. Further, the hole 30 may be configured to provide an adequate resistance to the disinfecting wipes, in order to facilitate the perforation of a single disinfecting wipe when it is pulled through the hole 30.

According to another exemplary embodiment, a liner 29 is not coupled to the base 26, and the base is instead configured to include a portion that substantially covers the hole 16. That is, a portion of the base 26, proximate a top of the shank 24, may extend inwardly and terminate at a hole or aperture (similar to the hole 30).

According to an exemplary embodiment, a bottom surface of the base 26 is configured to seal against a top surface of a mounting surface (e.g., the top surface of a sink or countertop). For example, a sealing member (not shown), such as a silicone or rubber gasket may be used to provide a watertight seal between the base 26 and a sink/countertop. The base 26 may also include a rubberized coating used to provide a watertight seal between a mounting surface. According to another exemplary embodiment, a sealant (e.g., silicone caulk) may be used to provide a seal between the cover 22 and a mounting surface. As a result, the cover 22 may be configured to prevent a disinfecting solution that is impregnated on a roll of disinfecting wipes from evaporating between the sink deck 8 and the base 26. According to another exemplary embodiment, a bottom surface of the base 26 does not have to form a seal against the top surface of the sink or countertop in order to prevent a disinfecting solution from evaporating between the sink deck 8 and the base 26.

According to an exemplary embodiment, the base 26 is made out of plated acrylonitrile-butadiene-styrene (ABS) (i.e., chrome-plated ABS). According to other exemplary embodiments, the base 26 may be made out of another polymeric material, a metal (e.g., stainless steel, a plated metal, etc.), or any other suitable material. The diameter of the base 26 may be approximately 2½ inches and the height of the base 26 may be approximately 0.75 inches. It is noted that the relative dimensions of a base may vary, and that the dimensions of the base 26 disclosed herein are not limiting. A top surface of the base 26 and/or the liner 29 may be curved. For example, a top surface of the base 26 and the liner 29 may be a radially and inwardly curved convex or concave surface (e.g., such that the top surface of the base 26 and the liner 29 are inwardly dished). According to another exemplary embodiment, the top surfaces of the base 26 and/or the liner 29 may be downwardly tapered from outer portions thereof towards the hole 30. According to other exemplary embodiments, the base 26 may be configured in any suitable manner.

Referring still to FIG. 3A, according to an exemplary embodiment, the shank 24 extends downward from the bottom surface of the base 26. The shank 24 is configured to be concentric with the hole 30 disposed within the liner 29. The shank 24 is also configured to be received by the hole 16 through a top surface of a countertop or sink deck. When the shank 24 is received by the hole 16, at least a portion of the shank 24 may extend below the bottom surface of the mounting surface (e.g., a countertop or the sink deck 8). According to an exemplary embodiment, an outer (e.g., external) surface of the shank 24 may be threaded (e.g., having male threads). Accordingly, a fastener, such as a threaded nut 32, may be threaded onto a portion of the shank 24 that extends below the bottom surface of the mounting surface, thereby securing the base 26 to the mounting surface (e.g., a countertop or the sink deck 8). According to another exemplary embodiment, the shank 24 may include a plurality of snap members (not shown) which are configured to flex (i.e., bend, deform, etc.) inwards when received by the hole 16, and snap outwards once the snap members extend below the bottom surface of the mounting surface, thereby securing the shank 24 to the mounting surface. It is noted that the methods disclosed herein for securing the cover 22 to a mounting surface are not limiting, and the shank 24 may be configured to couple to the hole 16 in any suitable manner, according to other exemplary embodiments.

Further referring to FIGS. 3A and 3B, according to an exemplary embodiment, the lid 28 is configured to be coupled to the base 26. For example, the lid 28 may be coupled to the base 26 via a hinge (not shown, but, e.g., a pin hinge, a flexible "living hinge," etc.), in which a first end of the hinge is coupled to the lid 28 and a second end of the hinge is coupled to the base 26. The lid 28 may pivot about the hinge between open and closed positions (e.g., raised and lowered positions). According to an exemplary embodiment, the hinge may be biased to put the lid 28 in the open position. The hinge may also elastically deform when the lid 28 is moved between closed and open positions. For example, a portion of the hinge may be formed from a spring (e.g., spring steel may be used) that biases the lid 28 to be in the open position. According to an exemplary embodiment, at least a portion of the hinge is formed from an elastic material, such as spring steel. Also, a spring steel portion of the hinge may be overmolded with a flexible polymeric material. According to another exemplary embodiment, a spring steel portion may be press-fit into a polymeric piece having a hollow portion. According to another exemplary embodiment, an elastic hinge may bias the lid 28 to be in a closed position. Although a particular hinge used with the cover 22 has been herein disclosed, any other suitable hinge may be used to couple the lid 28 to the base 26, according to other exemplary embodiments.

According to an exemplary embodiment, the lid 28 may be configured to pivot to an open position that is approximately 20-30° past vertical (when the base 26 is coupled to a mounting surface). Also, the lid 28 may be configured to allow a user's finger to lift (e.g., pivot) the lid 28 from a closed position to an open position. For instance, an outer radial surface of the lid 28 may include a protrusion (e.g., a projection, member, knob, handle, etc.) or a recession (e.g., a depression, divot, or space within a radial surface of the lid 28) that may be configured such that a user's finger may pull the protrusion/recession to lift the lid 28. According to another exemplary embodiment, the cover 22 may include a mechanism, such as a latch (not shown), which is configured to release a closed lid 28, so that the lid 28 may pivot about a hinge to the open position. Such a latch may be configured as a button (e.g., a button that a user may depress, and thereby release the lid so that it may pivot to the open position). According to another exemplary embodiment, the cover 22 may be configured with a "push-to-open" lid 28 in which the lid 28 is initially pushed downward to release the lid to the open position. Although various methods have been herein disclosed to release the lid 28 from the closed position, it should be understood that these methods are not limiting, and that the cover 22 and lid 28 may be configured in any suitable manner, according to other exemplary embodiments.

According to an exemplary embodiment, in the case in which a hinge or spring biases the lid 28 to be in an open position, the lid 28 may also include a mechanism, such as a latch (not shown), that is configured to hold (e.g., retain, clasp, etc.) the lid 28 in the closed position. For example, according to an exemplary embodiment, a recession may be formed on an outer surface of the base 26 which is configured to receive a protrusion formed on an inner surface of the lid 28 when the lid is in a closed position. Although a method has been herein disclosed to retain the lid 28 in a closed position, it should be understood that the cover 22 and lid 28 may be configured in any suitable manner, according to other exemplary embodiments.

According to an exemplary embodiment, a watertight seal may be formed between the bottom surface of the lid 28 and a top surface of the base 26 or the liner 29, when the lid 28 is in a lowered position and engaged with the base 26. For example, the lid 28 may engage the liner 29 to provide a watertight seal therebetween. According to another exemplary embodiment, a sealing member (not shown, but, e.g., a gasket, o-ring, or any suitable sealing part) may be provided proximate an outer edge of the bottom surface of the lid 28 or proximate an outer edge of an upper surface of the base 26 to provide a watertight seal between the lid 28 and the base 26/liner 29 when the lid 28 is in a closed position. According to an exemplary embodiment, such a sealing member may be configured to prevent a disinfecting solution from evaporating between the lid 28 and the base 26.

Figure 4:
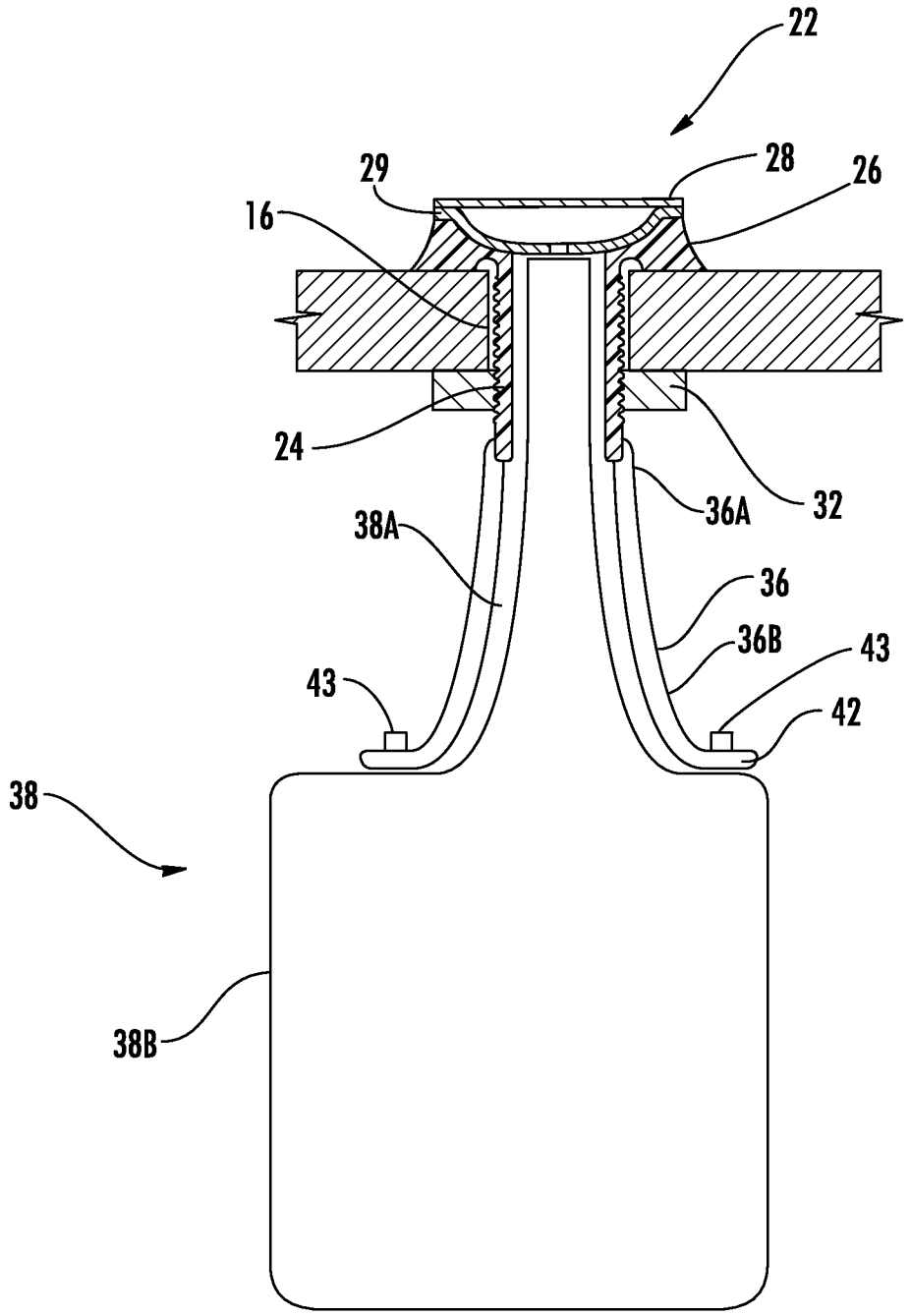
FIG. 4 is a cross-sectional view of a dispensing wipes system, such as that shown in FIGS. 2A-2B.

FIG. 4 illustrates an exemplary embodiment for the funnel (e.g., a connector) 36, which is configured to be coupled at a top end 36A to the shank 24, and at a bottom end 36B to the case 38. The funnel 36 is hollow between the top end 36A and the bottom end 36B. As shown in FIG. 4, this exemplary embodiment for the funnel 36 is generally conical, such that the funnel 36 is tapered outwardly from a relatively narrow top end 36A to a relatively wider bottom end 36B. According to other exemplary embodiments, the funnel 36 may be generally cylindrical, generally conical, or have any other suitable tapered shape. A flange 42 may extend radially outward from the bottom end 36. The flange 42 may be configured to engage a top surface of a case body 38B. According to an exemplary embodiment, the funnel 36 may be approximately 2½ inches in height, and an outer diameter of the flange 42 may be approximately 3 inches. It is noted that the height and/or diameter of a funnel for a dispensing wipes system may vary, and that the funnels disclosed herein are not limiting.

Referring still to FIG. 4, according to an exemplary embodiment, an inner surface of the top end 36A of the funnel 36 includes female threads, thus allowing the funnel 36 to be threaded onto the outer threads of the shank 24. According to other exemplary embodiments, the funnel 36 may be configured to be coupled to the shank 24 in any suitable manner (i.e., snap-fit, press-fit, clamped, etc.). According to an exemplary embodiment, the flange 42 is configured to be magnetically coupled to a roof of the case body 38B. For example, a plurality of magnets 43 may be coupled to the flange 42, and a plurality of magnets (not shown) may be coupled to the roof of the case body 38B. According to this exemplary embodiment, the magnetic forces of the magnets provided on the flange 42 and the case 38 are sufficient to retain the case 38 (housing a roll of disinfecting wipes) against the funnel 36. According to other exemplary embodiments, the bottom end of the funnel 36 may be configured to be coupled to the case 38 in any suitable manner (e.g., snap-fit, threadably coupled, press-fit, clamped, coupled using bayonet coupling, etc.). According to an exemplary embodiment, the funnel 36 may be configured to seal against the case 38. For example, a sealing member (not shown, but, e.g., a gasket, an o-ring, or any suitable sealing member) may be provided proximate the bottom surface of the flange 42 or on the roof of the case body 38B. According to an exemplary embodiment, the sealing member may be configured to prevent a disinfecting solution from evaporating between the case 38 and funnel 36.

Referring still to FIG. 4, according to an exemplary embodiment, the bottom end 36B of the funnel 36 is configured to be received by a case stem 38A of the case 38. For example, an inner surface of the funnel 36 may generally correspond to a portion of an outer surface of the case stem 38A. For a funnel/case stem that include portions that are generally conical (i.e., tapered), the case stem 38A may be vertically constrained by the inner surface of the funnel 36. The case 38 may also be vertically constrained within the funnel 36 by the flange 42. According to an exemplary embodiment, the heights of the funnel 36, the case stem 38A, the base 26, and/or the liner 29 may be cooperatively configured such that the case stem 38A extends upwards through the funnel 36 and the cover 22 to a predetermined height. For example, the case stem 38A may be configured to extend upwards so that it is flush with a top surface of the base 26, a top surface of the liner 29, a bottom surface of the liner 29, or a bottom surface of the base 26.

Figure 5:
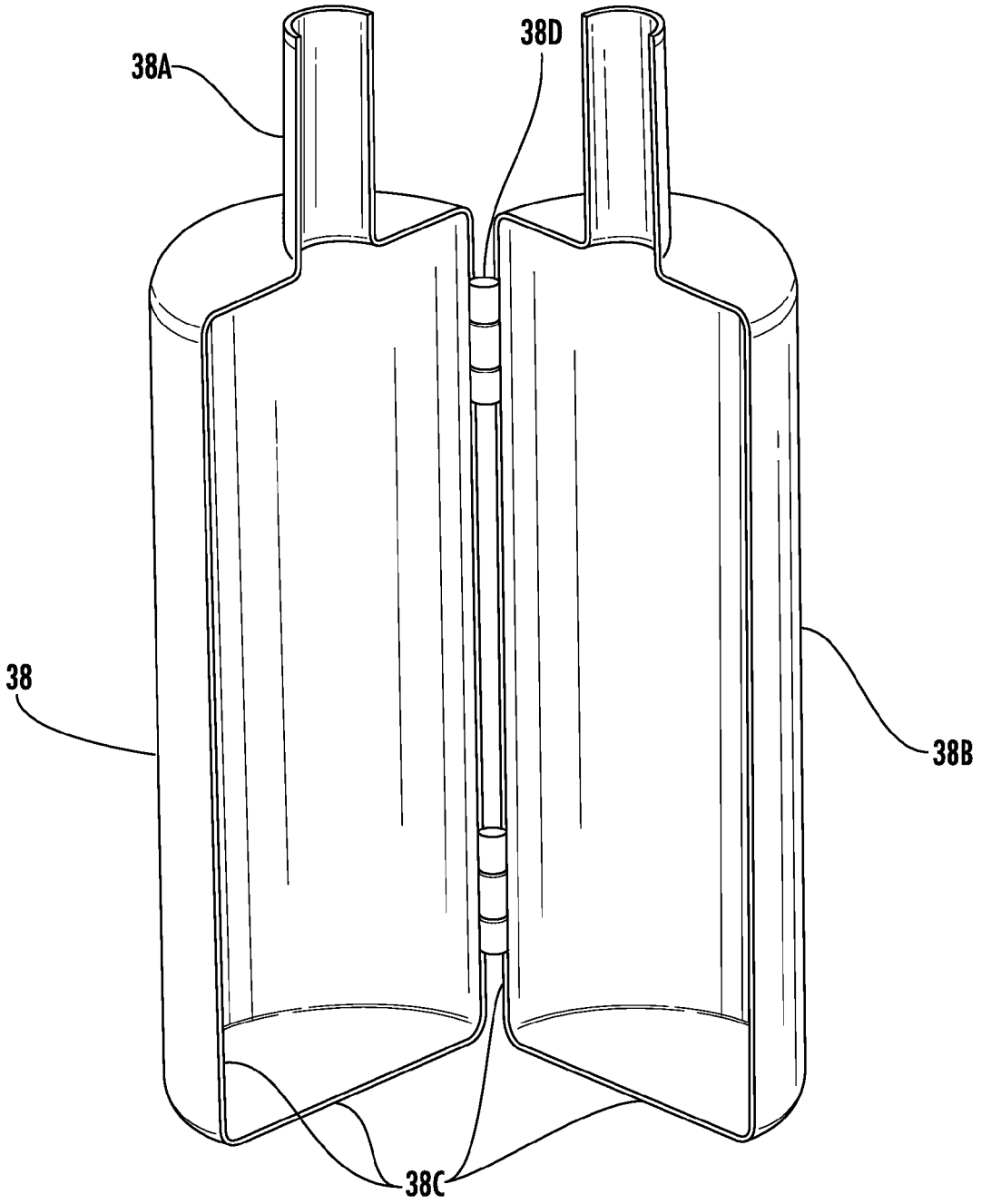
FIG. 5 is a perspective view of a case for a dispensing system, such as that shown in FIGS. 2A-2B.

FIG. 5 illustrates an exemplary embodiment of the case 38. The case 38 is configured to house (i.e., contain, receive, hold, etc.) a container that contains therein a roll of disinfecting wipes (see, e.g., FIG. 6C). According to another exemplary embodiment, the case 38 may house a roll of disinfecting wipes that are removed from a separate container. According to an exemplary embodiment, the case 38 may be made from a polymeric material. According to other exemplary embodiments, the case 38 may be made from a metal or any other suitable material.

As shown in FIG. 5, the case 38 includes a case body 38B and the case stem 38A, which extends upwards from an upper surface, or roof of the case body 38B. The case body 38B is the portion of the case 38 used to primarily house the disinfecting wipes container 20. For example, a height and a diameter of the case body 38B may generally correspond to a height and diameter of a commercially available disinfecting wipes container. The case 38 is hollow between the case body 38B and the case stem 38A. Thus, a single disinfecting wipe may be pulled from within the case body 38B and through the case stem 38A. It is noted that the relative dimensions of a case may vary, based on various sizes of disinfecting wipes containers and the relative dimensions of various drop-in mounted sinks, and that the cases disclosed herein is not limiting.

FIG. 5 illustrates an exemplary embodiment of a case 38, in which the case 38 has a clamshell design that includes two halves. Each half of the clamshell design of the case 38 is shown to comprise portions of the case body 38B and the case stem 38A. The two halves of the case 38 may be coupled together through a hinge, such as a pin hinge 38D. The two halves of the case 38 may thereby pivot about the pin hinge 38D between open and closed configurations. As shown in FIG. 5, the pin hinge 38D is provided on a lateral side of the case body 38B. According to other exemplary embodiments, the pin hinge 38D may be provided on a bottom side of the case body 38B, or in any other suitable location. It should be understood that the two halves of the case 38 may be coupled in any suitable manner, and that the manners disclosed herein are not intended to be limiting. For example, the two halves may be coupled via a "living hinge" along an edge that runs along the height of the case 38 (similar to the pin hinge 38D). The two halves may also be coupled via a hinge (e.g., a pin hinge, living hinge, etc.) provided along a bottom edge of each half. Also, instead of a hinge, the two halves of the case 38 may be configured to couple together via a snap fit.

Referring further to FIG. 5, each half of the case 38 includes an edge 38C. The edge 38C of each half of the case 38 extends along a side of the case stem 38A, around the case body 38B, and to the opposite side of the case stem 38A. The edges 38C of each half of the case 38 are configured to be engaged when the case 38 is in a closed configuration. According to an exemplary embodiment, the edges 38C of the case 38 are configured to sealably couple when the case 38 is in a closed configuration in order to prevent a disinfecting solution from evaporating from the two halves of the case 38. The case 38 may also include a mechanism to secure (e.g., lock, latch, etc.) the two halves together when the case 38 is in a closed configuration.

According to an exemplary embodiment, the position of the case stem 38A is off-set from the center of a top surface of the case body 38B (i.e., when the case 38 is in the closed configuration). The case stem 38A is off-set from the center of the case body 38B so as to allow the case body 38B, which may be approximately 4 inches in diameter, to fit within the clearance between the hole 16 and the basin 12, which may be approximately 1½ inches or less. The clearance between the hole 16 and the basin 12 is illustrated by the dashed line in FIG. 1. Accordingly, because the case stem 38A is off-set from a center of the case body 38B, the two halves of the case 38 are not symmetrical (e.g., the case body/case stem portions of one half of the case 38 may be larger than the case body and/or case stem portions of the other half of the case 38). According to an exemplary embodiment, a dispensing wipes system 18 may include a relatively narrow case 38 having a case stem 38A that is centered on a top surface of a case body 38B. Such a case 38 is narrow enough to fit within the clearances between the basin 12 and the hole 16.

According to an exemplary embodiment, a top portion of the case stem 38A may include a sealing member (not shown, but, e.g., a gasket, o-ring, silicone or overmolded TPE part, or any suitable sealing part). The sealing member may couple to the case stem 44 in a variety of ways. According to an exemplary embodiment, an upper edge of the case stem 44 includes a groove (i.e., a recession, slot, etc.), and the sealing member is pressed into the groove. According to another exemplary embodiment, the sealing member is overmolded onto an upper edge of the case stem 38A. It should be understood that a sealing member may be coupled to the case stem in other suitable manner, according to other exemplary embodiments, and the methods disclosed herein are not limiting.

According to an exemplary embodiment, the sealing member is removable from the case stem. According to an exemplary embodiment, the sealing member is generally configured to cover a top opening of the case stem 38A, and includes an aperture through which disinfecting wipes may be pulled therethrough. According to an exemplary embodiment, the sealing member is configured so its mechanical resistance to a disinfecting wipe that is pulled therethrough is low enough to allow a single disinfecting wipe to be pulled therethrough, and high enough to allow the wipe pulled therethrough to tear along a perforation between consecutive disinfecting wipes.

Figure 6A:
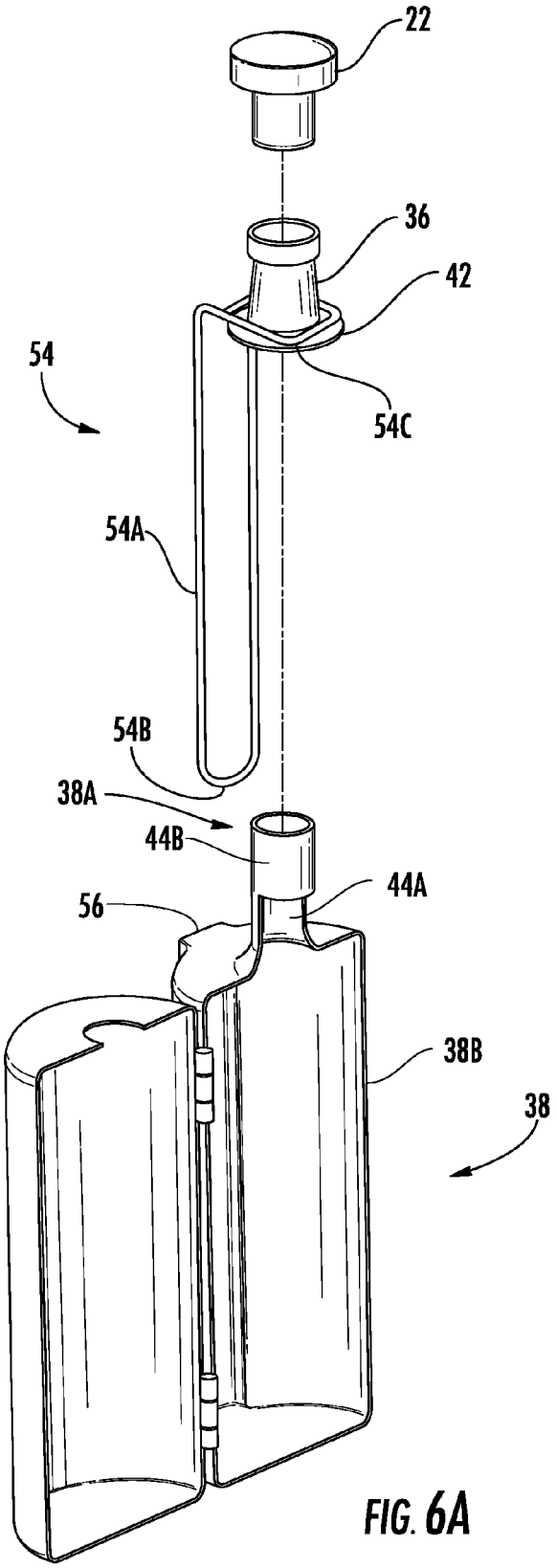
FIG. 6A is an exploded perspective view of a dispensing wipes system in a disassembled state, according to an exemplary embodiment.

FIG. 6A illustrates an exemplary embodiment of a dispenser system 18 for a disinfecting wipes container. The dispenser system 18 includes a case 38 having a case stem 38A and a case body 38B. As described above, the position of the case stem 38A may be off-set from a center of an upper surface of the case body 38B. Further, the case stem 38A may include two sections, which are illustrated in greater detail in FIGS. 6B-6D. In contrast to the case stem 38A shown in FIG. 5, the case stem 38A shown in FIGS. 6A-6D includes a lower, partial tube portion 44A, and an upper, complete tube portion 44B, according to an exemplary embodiment. For example, the partial tube portion 44A may be openly disposed on only one side of the case stem 44. In other words, the case stem 38A extends upwards from the case body 38B on only one half of the case 38. Further, the complete tube portion 44B extends upward from the partial tube potion 44A. According to an exemplary embodiment, the complete tube portion 44B may include an integrally formed top surface which include an aperture through which disinfecting wipes may be received.

Figure 6B:
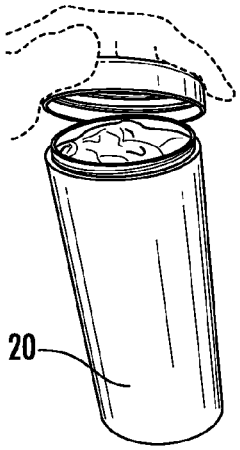
FIG. 6B illustrates a user preparing a disinfecting wipes container for use in a dispensing wipes system, according to an exemplary embodiment.
Figure 6B:
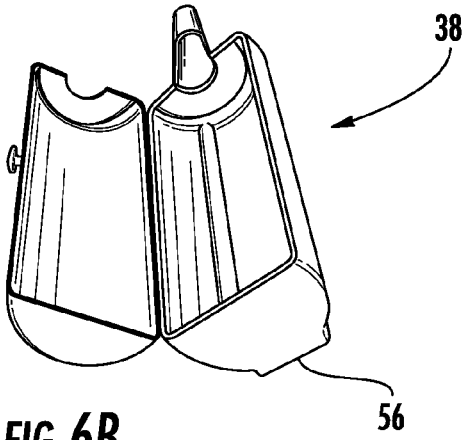
Figure 6C:
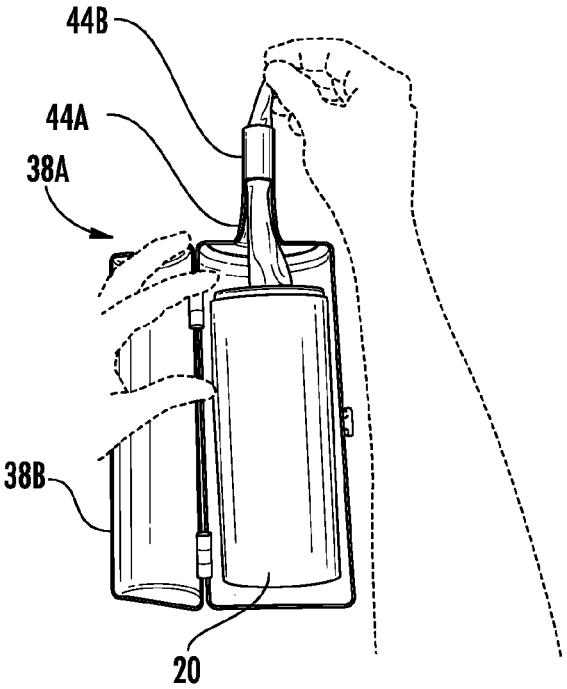
FIG. 6C illustrates a user inserting a dispensing wipes container into a case of a dispensing wipes system, according to an exemplary embodiment.
Figure 6D:
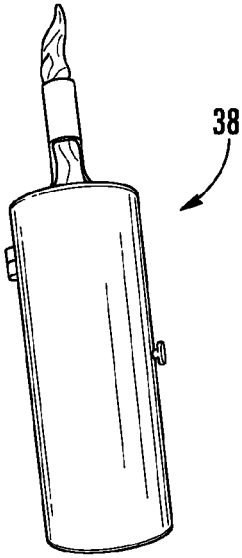
FIG. 6D illustrates a disinfecting wipes container installed within a case of a dispensing wipes system, according to an exemplary embodiment.

Referring to FIGS. 6B-6D, according to an exemplary embodiment, the case stem 38A may be configured to facilitate loading of an "end wipe" of a roll of disinfecting wipes. For example, referring to FIG. 6C, the open section of the partial tube portion 44A may allow a user to easily push (i.e., insert, place, thread, etc.) an "end wipe" through the aperture of the complete tube portion 44B. According to an exemplary embodiment, a method of loading a disinfecting wipes container 20 into the case 38 may include approximately six steps, which are shown in sequence in FIGS. 6B-6D. First, referring to FIG. 6B, the cover of the commercially available disinfecting wipes container 20 may be removed. Second, the "end wipe" in the roll of disinfecting wipes may be pulled a short distance from the top opening of the disinfecting wipes container 20. Third, referring to FIG. 6C, with the case 38 in an open configuration, the disinfecting wipes container 20 may be received (e.g., placed, laid, set, etc.) in one half of the case 38, so that the top opening of the wipes container 20 is oriented toward the case stem 38A. Fourth, referring still to FIG. 6C, the "end wipe" may be placed across the partial tube portion 44A, and pulled through the complete tube portion 44B. Fifth, referring to FIG. 6D, the two halves of the case 38 may be pivoted in order to bring the case 38 to a closed configuration. Sixth, a sealing member having an aperture (not shown, but, e.g., a sealing member configured to be coupled to the top of the case stem 38A) may be coupled to the closed case 38. In conclusion, a disinfecting wipes container 20 may be contained within the closed case 38, and the end wipe may extend from the aperture of the sealing member.

Figure 6E:
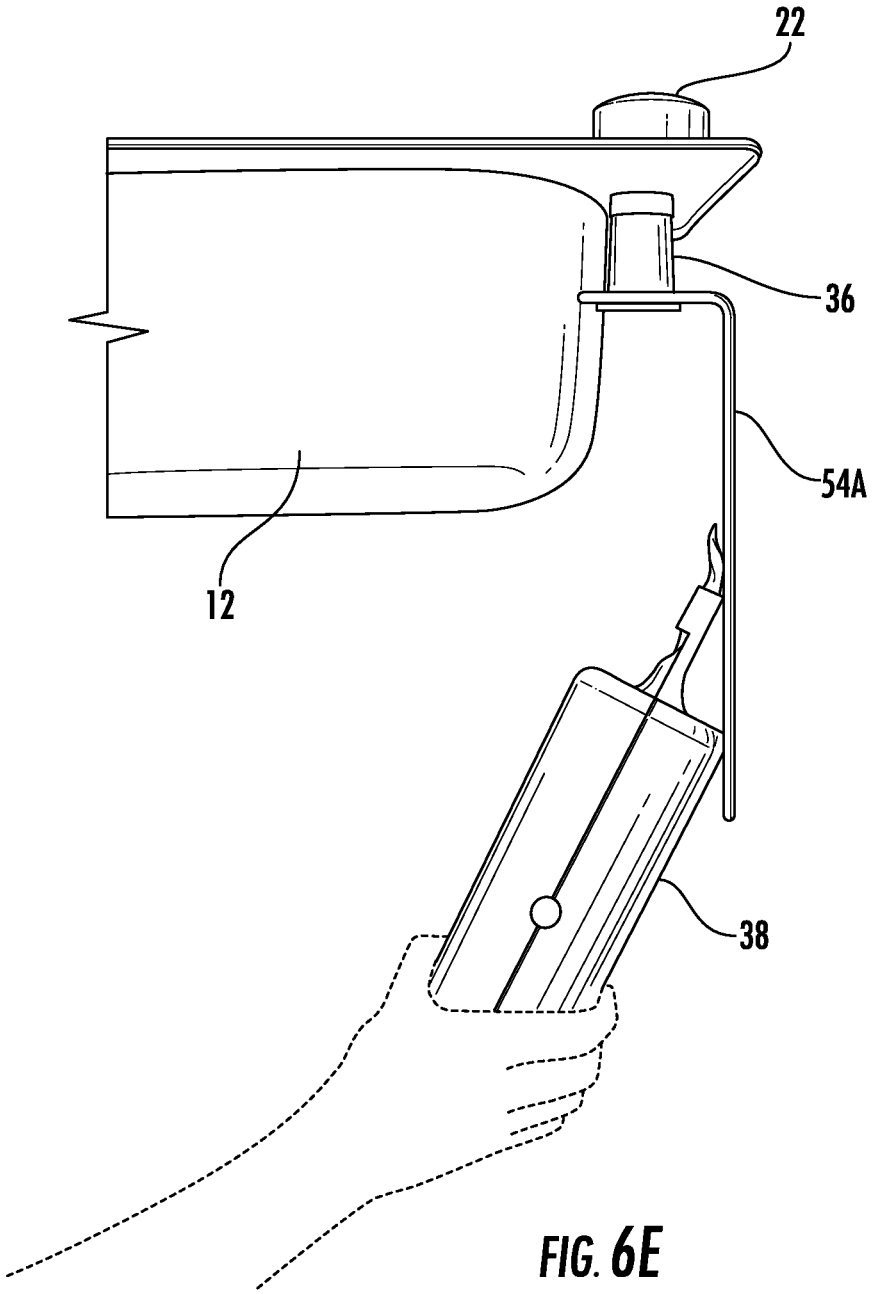
FIG. 6E illustrates a case of a dispensing wipes system being assembled to a connector of the dispensing wipes system.

According to an exemplary embodiment, when the case 38 is loaded with a disinfecting wipes container, the case 38 may thereafter be coupled to the funnel 36 and the cover 22. Referring to FIGS. 4, 6A, and 6E, the funnel 36 and the shank 24 may receive the case stem 38A. Further, a sealing member of the case stem 38A may be configured to be flush with either the top or bottom surfaces of the base 26 and/or the liner 29 when the case 38 is coupled to the funnel 36. According to other exemplary embodiments, the case stem 38A is not provided with a sealing member, and an "end wipe" is instead pulled through an aperture in the base 26 or the liner 29 of the cover 22. Therefore, according to an exemplary embodiment, the disinfecting wipes contained in the case 38 may be easily accessible from the top of a sink/counter by simply lifting the lid 28 of the cover 22. According to an exemplary embodiment, the dispensing system may be easily disassembled when the disposable wipes within the case 38 are depleted. The case 38 may be detached (i.e., de-coupled, removed, etc.) from the funnel 36, and placed in an open configuration.

Commercially available cylindrical containers used to package disinfecting wipes may come in a variety of sizes. For example, smaller containers may be approximately 3 inches in diameter, whereas larger containers may be approximately 5 inches in diameter. Referring to the underside of the sink 10, a clearance between the basin 12 and the hole 16 (shown, for example, by the dashed circle in FIG. 1) may be approximately 1½ inches. According to an exemplary embodiment, in order to overcome the limited clearance between a basin of the sink 10 and the hole 16, the case stem 38A may be off-set from the center of the case 38. Therefore, for a sink 10 which has a clearance of approximately 3 inches between a basin 12 and a hole 16, a dispensing system 18 may include a case 38 that has a diameter greater than 3 inches and a case stem 38A which is off-set from the center of the case 38.

According to another exemplary embodiment, a sink includes a rear sink deck with a series of mounting holes, as well as one or more basins. The sink is further configured to be used with a disinfecting wipes dispenser system 18 which includes a case having a case stem, in which the case stem is not off-set. According to this exemplary embodiment, a mounting hole within the sink deck is positioned approximately at least 2½-3 inches from the basin(s). Therefore, a case (similar to the case 38 having a clamshell deign) may be used in which a case stem is generally positioned in a center of a case body of the case.

Referring now to FIGS. 2A-2B, 6A-6B, and 6E, according to an exemplary embodiment, the dispensing system 18 may include a guide 54. The guide 54 may be configured to visually aid or assist a user in positioning the case 38 during the installation process of the dispensing system 18. For example, when viewed from the front, the hole 16 within a sink deck 8 is generally going to be hidden from view by the basin 12. Similarly, a mounting hole in a countertop may be hidden from view by an obstruction, such as a sink basin. The guide 54 may be a wire form which comprises two vertical bars 54A that extend downward from the funnel 36 to a distance that is below the bottom surface of the basin 12 of the sink 10. Therefore, when the cabinet doors in front of the sink 10 are open, the guide 54 may be visible from the front of the sink 10.

The guide 54 may be coupled to the dispensing system 18 in any suitable way, and the methods disclosed herein are not intended to be limiting. For example, referring to FIG. 6A, the guide 54 includes a wire hoop 54C that is generally perpendicular to the vertical bars 54A. The hoop 54C may be configured to be received by a narrower top end 36A of the funnel 36, and further constrained by a wider bottom end 36B of the funnel 36. According to another exemplary embodiment, the guide 54 could be configured to couple (e.g., thread) to the shank 24 of the cover 22. The guide 54 may also be coupled to a rear or side wall of the cabinet, proximate the hole 16.

Referring to FIGS. 2B and 6A-6B, according to an exemplary embodiment, an outer surface of one half of the case 38 may include a protrusion 56 (e.g., projection, member, lip, etc.) which extends radially outwards from the outer surface of the case 38. In addition, the protrusion 56 may extend vertically along the outer surface of the case 38. According to an exemplary embodiment, the protrusion 56 may be configured to be received between the two vertical bars 54A of the guide 54. Thus, the protrusion 56 and the guide 54 may be complementary configured to position the case 38 within the funnel 36.

Referring to FIGS. 2A and 6A, the two generally vertical bars 54A are coupled at a bottom end by a generally horizontal bar 54B. According to an exemplary embodiment, when the case 38 is assembled to the funnel 36, as shown in FIGS. 2A-2B, the bottom horizontal bar 54B is configured to engage a bottom portion of the protrusion 56 in order to partially support the case 38 when it is coupled to the funnel 36.

Other methods may be used to facilitate positioning of the case 38 within the funnel 36, according to other exemplary embodiments. According to another exemplary embodiment, the funnel 36 may extend below the basin 12. Thus, the funnel 36 may be visible from a front side of the basin 12, and a user may use the funnel 36 to guide the installation of the dispensing system 18. According to yet another exemplary embodiment, a guide may be a single vertical bar that extends downward from a funnel 36. For such a guide, the case body 38B may include a vertical recession used to receive the guide, or two vertical protrusions used to receive the guide therebetween. According to yet another exemplary embodiment, the case stem 38A and the funnel 36 may be oval-shaped, or egg-shaped, in order to limit the ways in which the case 38 is received within the funnel 36, thereby facilitating the positioning of the case 38 within the funnel 36. It should be understood that the exemplary embodiments disclosed herein for positioning a case within a funnel are not limiting, and that a dispensing wipes system may be configured in other ways to facilitate positioning of a case relative to a funnel, according to other exemplary embodiments.

FIGS. 7-12 illustrate another exemplary embodiment for a dispensing system 118 that couples to a disinfecting wipes container 120. The dispensing wipes system 118 may include a funnel 160 and a cover 122. According to various exemplary embodiments, the funnel 160 and the cover 122 may be made from a polymeric material, a composite material, a metal, or any other suitable material.

Figure 9:
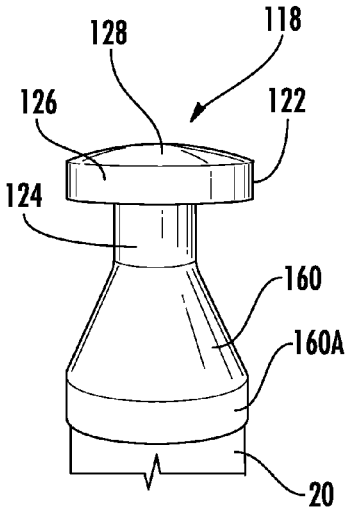
FIG. 9 illustrates a cover of a dispensing wipes system assembled to a funnel of the dispensing wipes system, according to an exemplary embodiment.
Figure 12:
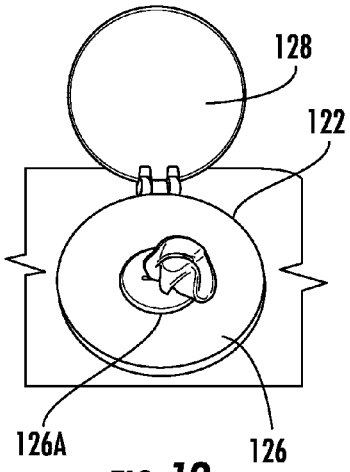
FIG. 12 illustrates the dispensing wipes system shown in FIG. 11, in which the lid of the cover is in a raised position to allow a disinfecting wipe to be pulled through an aperture of the cover, according to an exemplary embodiment.

Referring to FIG. 9, according to an exemplary embodiment, the cover 122 may include a shank 124, a base 126 and a lid 128. The base 126 may be generally cylindrical, or have any other suitable configuration. Referring to FIG. 12, a hole 126A is disposed within a central portion of the base 126. The hole 126A of the base 126 is configured such that, when the cover 122 is coupled to a hole disposed within a counter or a sink deck (e.g., the hole 16 shown in FIG. 1), the hole 126A of the base 126 and the hole of the sink deck are concentric. According to an exemplary embodiment, a bottom surface of the base 126 is configured to seal against a mounting surface (e.g., a top surface of the sink or countertop). For example, a sealing member (not shown, but, e.g., a gasket, o-ring, or any suitable sealing part) may be used to provide a seal between the base 126 and the mounting surface. According to an exemplary embodiment, the sealing member may be configured to prevent a disinfecting solution from evaporating between the mounting surface and the base 126.

According to an exemplary embodiment, the lid 128 may be configured to be sealingly engaged with the base 126, when the lid 128 is in a closed configuration, in order to prevent a disinfecting solution from evaporating past the lid 128 and the base 126. For example, a seal member (not shown, but e.g., a gasket, o-ring, rubberized coating, or any suitable sealing part) may be provided proximate a bottom surface of the lid 128 or an upper surface of the base 126.

Referring to FIG. 12, according to an exemplary embodiment, the lid 128 is configured to be coupled to the base 126. For example, a hinge (e.g., a pin hinge, living hinge, etc.) may be used to couple the lid 128 to the base 126. Accordingly, a first end of a hinge may be coupled to the lid 128 and a second end of the hinge may be coupled to the base 126. The lid 128 may pivot about the hinge between open and closed positions. According to an exemplary embodiment, the hinge may be configured to elastically deform when the lid 128 is moved between closed and open positions. For example, a portion of the hinge may be formed from a spring (e.g., spring steel may be used) that biases the cover 122 to be in an open position. According to an exemplary embodiment, at least a portion of the hinge is formed from an elastic material, such as spring steel. Also, a spring steel portion of the hinge may be overmolded with a flexible polymeric material. According to another exemplary embodiment, a spring steel portion may be press-fit into a polymeric piece having a hollow portion. According to another exemplary embodiment, an elastic hinge may bias the cover 122 to be in a closed position. Although various exemplary embodiments for hinges have been herein described, any other suitable hinge may be used to couple the lid 128 to the base 126, according to other exemplary embodiments.

According to an exemplary embodiment, the lid 128 may be configured to pivot to an open position that is approximately 20-30 degrees past vertical. Also, the lid 128 may be configured to allow a user's finger to lift (e.g., pivot) the lid 128 from a closed position to an open position. For instance, an outer radial surface of the lid 128 may include a protrusion (e.g., a projection, member, knob, handle, etc.) or a recession (e.g., a depression or space within a radial surface of the lid 128) that may be configured such that a user's finger may pull the protrusion/recession to lift the lid 128.

According to another exemplary embodiment, the cover 122 may include a mechanism, such as a latch (not shown), which is configured to release a closed lid 128, so that the lid 128 may pivot about a hinge to the open position. Such a latch may be configured as a button (e.g., a button that a user may depress, and thereby release the lid so that it may pivot to the open position). Although various methods have been herein described to release the lid 128 from the closed position, it should be understood that these methods are not limiting, and that the cover 122 may be configured in any suitable manner in order to release the lid 128 from the closed position to pivot to the open position.

According to an exemplary embodiment, in the case in which a hinge or spring biases the lid 128 to be in an open position, the lid 128 may also include a mechanism, such as a latch (not shown), that is configured to hold (e.g., retain) the lid 128 in the closed position. For example, according to an exemplary embodiment, a recession may be formed on an outer surface of the base 126 which is configured to receive a protrusion formed on an inner surface of the lid 128 when the lid is in a closed position. Although a method has been herein described to retain the lid 128 in a closed position, it should be understood that the cover 122 may be configured in any suitable manner in order to retain the lid 128 in a closed position, according to other exemplary embodiments.

Figure 10:
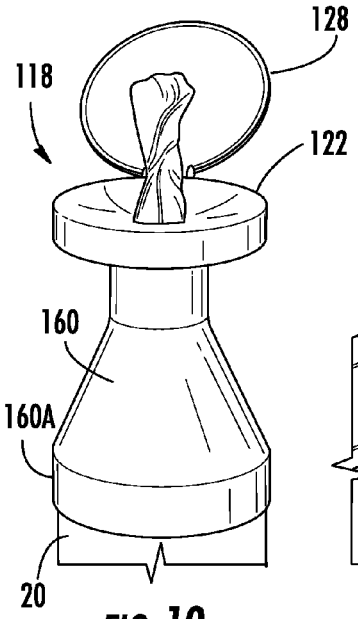
FIG. 10 illustrates a lid of the cover of the dispensing wipes system in a raised position, to allow a disinfecting wipe to be pulled through an aperture of the cover, according to an exemplary embodiment.
Figure 11:
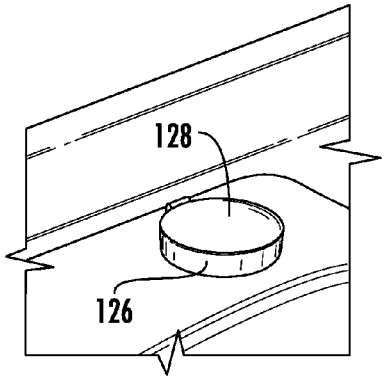
FIG. 11 illustrates the dispensing wipes system shown in FIG. 9 mounted to a mounting surface, according to an exemplary embodiment.

Referring to FIGS. 9-10, according to an exemplary embodiment, the shank 124 may extend downward from a central portion of the bottom surface of the base 126. The shank 124 is concentric with the hole 126A disposed within the base 126, and the diameter of the shank 124 may be larger than the diameter of the hole 126A disposed within the base 126. According to an exemplary embodiment, the shank 124 may be configured to be received by a mounting hole disposed within a countertop or sink deck (e.g., the hole 16 shown in FIG. 1). For example, the outer diameter of the shank 124 may generally correspond with the inner diameter of the mounting hole. Further, a length of the shank 124 may generally correspond to a depth of the mounting hole. According to another exemplary embodiment, the length of the shank 124 may be configured to be greater than the depth of the mounting hole. It should be noted that although a particular cover 122 has been described herein as including a shank 124, a base 126, and a lid 128, the cover 122 is not limiting.

Figure 7:
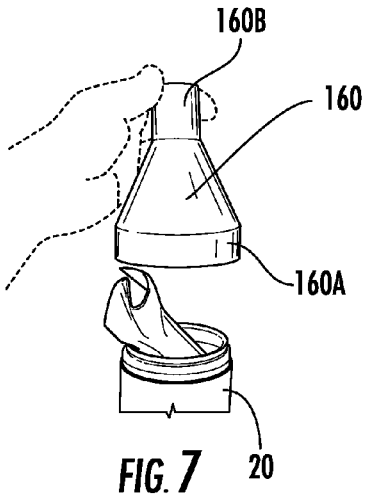
FIG. 7 illustrates a user assembling a funnel of a dispensing wipes system to a disinfecting wipes container, according to an exemplary embodiment.

Referring to FIG. 7, according to an exemplary embodiment, the funnel 160 includes a lower conical portion 160A and an upper stem 160B. The conical portion 160A of the connector 160 may be tapered inwardly from a bottom end to a top end proximate the stem 160B. According to an exemplary embodiment, the stem 160B may be generally cylindrical. According to other exemplary embodiments, the stem 160B of the funnel 160 may be generally conical, or have any other suitable tapered shape. According to an exemplary embodiment, the conical portion 160A and stem 160B of the connector 160 are hollow therethrough.

According to an exemplary embodiment, the stem 160B of the connector 160 is configured to be received within the shank 124, when the shank 124 is received within a mounting hole. Therefore, an outer diameter of the stem 160B may be configured to generally correspond with an inner diameter of the shank 124. Further, the height of the stem 160B, as measured between a top surface of the stem 160B and a transitioning point in which the stem 160B transitions into the conical portion 160A, may be configured to correspond to the combined depth of the sink deck hole and the height of the base 126. Therefore, when the stem 160B is received from below a mounting surface, such as a countertop or sink deck, the wider diameter of the conical portion 160A may vertically constrain the connector 160 so that the top surface of the stem 160B may be essentially flush with a top surface of the base 126.

According to an exemplary embodiment, the stem 160B and the shank 124 may be configured to be coupled together. For example, the stem 160B and the shank 124 may be threadably coupled, magnetically coupled, have a snap-fit, couple using a "¼-turn lock", coupled using a bayonet mounting connection, or coupled together in any suitable way.

According to an exemplary embodiment, a top portion of the stem 160B may include a sealing member (not shown, but, e.g., a gasket, o-ring, silicone or overmolded TPE part, or any suitable sealing part). The sealing member may couple to the stem 160B in a variety of ways. According to an exemplary embodiment, an upper edge of the stem 160B includes a groove (i.e., a recession, slot, etc.), and the sealing member is pressed into the groove. According to another exemplary embodiment, the sealing member is overmolded onto an upper edge of the stem 160B. It should be understood that a sealing member may be coupled to the stem 160B in other suitable manner, according to other exemplary embodiments, and the methods disclosed herein are not limiting.

According to an exemplary embodiment, the sealing member is removable from the stem 160B. According to an exemplary embodiment, the sealing member is generally configured to cover a top opening of the stem 160B, and includes an aperture through which disinfecting wipes may be pulled therethrough. According to an exemplary embodiment, the sealing member is configured so its mechanical resistance to a disinfecting wipe that is pulled therethrough is low enough to allow a single disinfecting wipe to be pulled therethrough, and high enough to allow the wipe pulled therethrough to tear along a perforation between consecutive disinfecting wipes.

Referring to FIGS. 7-10, according to various exemplary embodiments, the conical portion 160A of the funnel 160 is configured to couple to a disposable wipes container, such as a commercially available cylindrical disinfecting wipes container 120. For example, a cylindrical disinfecting wipes container 120 may include a lid that is threadably coupled to a top end of the container. For such a container, the conical portion 160A may include threads that correspond to the lid of the wipes container 120. In this case, a user would remove (e.g., unscrew) the lid from the container and couple (e.g., screw) the conical portion 160A to the container 120. According to another exemplary embodiment, an outside radial surface proximate the top end of the wipes container may include a radial flange or a radial groove, and an inside radial surface of a lid for the wipes container 120 may include a radial flange or radial groove that is configured to "snap" over the radial flange/groove of the wipes container. For a container having such a "snap-fit" configuration, the conical portion 160A may include a flange/groove corresponding to the lid. In this case, a user would remove (e.g., pull or lift) the lid from the container 120 and "snap" the conical portion 160A onto the container. Although a variety of methods have been described for how the conical portion 160A may be coupled to a disposable wipes container 120, it should be understood that other suitable methods may be used to couple the conical portion 160A to a wipes container, according to other exemplary embodiments, and that the methods disclosed herein are not limiting. Further, although a particular funnel (e.g., connector) 160 has been disclosed as having a lower conical portion 160A and an upper cylindrical portion 160A, it should be understood that a funnel may be configured in other ways, according to other exemplary embodiments, and that the funnels disclosed herein are not limiting.

Figure 8:
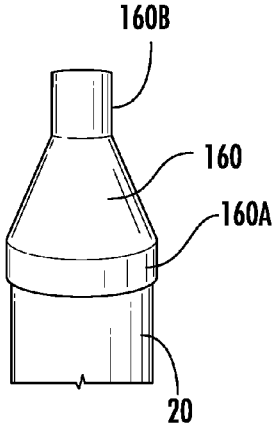
FIG. 8 illustrates a funnel of a dispensing wipes system and a disinfecting wipes container in an assembled state, according to an exemplary embodiment.

According to an exemplary embodiment, a method to assemble the dispensing system 118 with a disinfecting wipes container 120 may include approximately five steps, which are illustrated in sequence in FIGS. 7-12. First, the cover of the commercially available disinfecting wipes container 120 may be removed. Second, as shown in FIGS. 7-8, the "end wipe" in the roll of disinfecting wipes may be pulled a short distance from the top opening of the disinfecting wipes container 120, pulled through the conical portion 160A of the funnel 160, and extend through the stem 160B. Third, the funnel 160 is coupled to the wipes container 120. Fourth, the "end wipe" may be pulled through (e.g., received by) a sealing member, and the sealing member may be coupled to the funnel 160. Fifth, the stem 160B of the funnel 160 may be coupled to the shank 124. According to an exemplary embodiment, after the dispensing wipes have become exhausted, disassembly of the dispensing system 118 may be accomplished in as little as two steps. First, the funnel 160 is uncoupled from the cover 122. Second, the empty disinfecting wipes container 120 is uncoupled from the funnel 160.

According to another exemplary embodiment, a dispensing system for disinfecting wipes includes a cover, such as the cover 22 shown in FIGS. 3A-3B, and the cover is positioned below a bottom surface of a mounting surface (e.g., a bottom wall of an overhead cabinet). The dispensing wipes system may further include a funnel, such as the funnel 36 shown in FIG. 4, which is positioned within an overhead cabinet and coupled to the cover. A case, such as the case 46, may house a roll of disinfecting wipes, and couple to the connector and the cover, so that a disinfecting wipe may be accessed from below the bottom surface of the overhead cabinet.

According to another exemplary embodiment, a dispensing system for disinfecting wipes includes a cover, such as the cover 22 shown in FIGS. 3A-3B, and the cover is positioned on a vertical mounting surface (e.g., an exterior surface of a side wall of an overhead cabinet). According to this exemplary embodiment, a dispensing wipes system may be configured so that a roll of disinfecting wipes is positioned within the overhead cabinet and a disinfecting wipe may be accessed from an exterior surface of a side wall of the overhead cabinet.

As utilized herein, the terms "approximately," "about," "substantially," "essentially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the disclosure as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the dispensing system as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, manufacturing processes, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present disclosure.

What is claimed is:

1. A disposable wipes dispenser system, the dispenser system comprising:

a case configured to contain a disposable wipes container;

a cover including a lid and a shank configured to mount in a mounting hole disposed within a mounting surface, wherein the shank is configured to be received in the mounting hole; and a funnel configured to couple to the disposable wipes container and to the cover when the funnel is positioned below the mounting surface;

wherein the case is configured to couple to the cover from below the mounting surface; and wherein the disposable wipes are accessible from above the mounting hole when the cover is coupled to the mounting surface, the funnel is coupled to the cover, and the disposable wipes container is coupled to the funnel.

2. The dispenser system of claim 1, wherein the shank extends below a bottom surface of the mounting surface.

3. The dispenser system of claim 2, wherein the mounting surface is a rear deck of a sink.

4. The dispenser system of claim 3, wherein the case is generally cylindrical in shape and has a diameter that is greater than a clearance distance between a center of the mounting hole and a basin of the sink.

5. The dispenser system of claim 2, wherein a narrow portion of the funnel is configured to couple to the shank when the shank is received by the mounting hole;

wherein the case is configured to be received by a wider portion of the funnel;

wherein the case and the funnel are cooperatively configured to be removably coupled.

6. The dispenser system of claim 5, wherein the case and the funnel are cooperatively configured to be magnetically coupled.

7. The dispenser system of claim 5, the cover further comprising a lid configured to pivot between open and closed positions;

wherein the cover, the case, and the funnel are cooperatively configured to prevent evaporation of a solution impregnated on the disposable wipes when the lid is in a closed configuration.

8. The dispenser system of claim 5, further comprising a guide coupled to the funnel;

wherein the guide and the case are cooperatively configured to facilitate positioning of the case relative to the funnel.

9. The dispenser system of claim 5, wherein the lid is coupled to the cover via a hinge, and wherein the lid is biased in an open position by the hinge.

10. A disposable wipes dispenser system, the dispenser system comprising:

a cover including a lid and a shank; and a funnel configured to couple to a disposable wipes container;

wherein the shank is configured to be received by a mounting hole disposed within a mounting surface;

wherein the cover is positioned above the mounting surface when the shank is received by the mounting hole;

wherein the funnel is configured to couple to the cover when the funnel is positioned underneath the mounting surface;

wherein the disposable wipes may be accessed from above the mounting surface when the cover is coupled to the mounting surface, the funnel is coupled to the cover, and the disposable wipes container is coupled to the funnel.

11. The dispenser system of claim 10, wherein the funnel includes a narrow end and a wider end;

wherein a seal member is coupled to the narrow end of the funnel and the disposable wipes container is coupled to the wider end of the funnel; and wherein an aperture is disposed within the seal member.

12. The dispenser system of claim 10, wherein the cover, and the funnel are cooperatively configured to prevent evaporation of a solution impregnated on the disposable wipes when the lid is in a closed configuration.

13. The dispenser system of claim 10, wherein the mounting surface is a deck of a sink.

14. A disposable wipes dispenser system, the dispenser system comprising:

a disposable wipes container;

a cover configured to mount to a mounting hole disposed within a rear deck of a sink;

a funnel having a first end configured to couple to the cover and an opposite second end, wherein the first end is more narrow than the second end; and a case configured to house the disinfecting wipes container and to couple to the second end of the funnel, the case including two halves that are coupled together via a hinge;

wherein a stem extends upward from a top surface of a body of the case, and the stem is configured to be received within the second end of the funnel;

wherein the disposable wipes container is coupled to the cover from below the rear deck; and wherein the disposable wipes are accessible from above the mounting hole when the disposable wipes container is coupled to the cover.

15. The dispenser system of claim 14, wherein the disposable wipes container is generally cylindrical in shape and has a diameter that is greater than a distance between a center of the mounting hole and an external surface of a basin of the sink.

16. The dispenser system of claim 14, wherein the stem is off-set on the top surface of the body of the case.

17. The dispenser system of claim 14, further comprising a guide coupled to the funnel;

wherein the guide is configured to facilitate positioning of the case relative to the funnel; and wherein the guide extends below a bottom surface of a basin of the sink.

* * * * *